US005956938A

United States Patent [19]

Brandenburg

[11] Patent Number: 5,956,938

[45] Date of Patent: Sep. 28, 1999

[54] MICROWAVE ELECTRO-THERMAL THRUSTER AND FUEL THEREFOR

[75] Inventor: John E. Brandenburg, Annandale, Va.

[73] Assignee: Research Support Instruments, Inc., Lanham, Md.

[21] Appl. No.: 08/738,449

[22] Filed: Oct. 25, 1996

Related U.S. Application Data

[63] Continuation-in-part of application No. 08/484,513, Jun. 7, 1995

[60] Provisional application No. 60/005,995, Oct. 27, 1995.

[51] Int. Cl.[6] ..... F03H 1/00

[52] U.S. Cl. ..... 60/203.1

[58] Field of Search ..... 60/200.1, 202, 60/203.1

[56] References Cited

U.S. PATENT DOCUMENTS

| | | | |
|---|---|---|---|
| 3,083,528 | 4/1963 | Brown | 60/203.1 |
| 3,114,517 | 12/1963 | Brown | 60/203.1 |
| 3,206,925 | 9/1965 | Schiff | 60/203.1 |
| 3,891,160 | 6/1975 | Minovitch | 244/1 SS |
| 4,815,279 | 3/1989 | Chang | 60/202 |
| 5,146,742 | 9/1992 | Iida et al. | 60/202 |

*Primary Examiner*—Louis J. Casaregola
*Attorney, Agent, or Firm*—Venable

[57] ABSTRACT

The present invention comprises a compact coupling for microwave-electro-thermal thrusters which use water-based fuels and microwave isolators.

2 Claims, 8 Drawing Sheets

MICROWAVE ELECTRO-THERMAL THRUSTER AND FUEL THEREFOR

CROSS-REFERENCE TO RELATED APPLICATIONS

The present application claims priority to a provisional patent application entitled "Microwave Electro-Thermal Thruster and Fuel", filed in the name of John E. Brandenburg on Oct. 27, 1995 and assigned Ser. No. 60/005,995. It is also a continuation-in-part of a patent application entitled "Compact Coupling for Microwave-Electro-Thermal Thruster", filed in the names of John E. Brandenburg and Michael Micci on Jun. 7, 1995 and assigned Ser. No. 08/484,513. Each of the above-noted applications are co-pending, commonly owned, and incorporated herein by reference.

BACKGROUND OF THE INVENTION

1. Field of the Invention

This present invention is related generally to control of spacecraft, and more particularly to control of propulsion and/or attitude of such spacecraft using microwave-electro-thermal (MET) thrusters.

2. Statement of the Prior Art

The invention described and claimed herein comprises an improved MET thruster and fuel therefor.

MET thrusters according to the present invention produce rocket thrust for the control of spacecraft via electricity for small satellites. A MET thruster produces high-temperature rocket exhaust by sending microwaves into a resonant cavity where an excited mode then creates an electrodeless discharge that heats gaseous or liquid fuel.

One drawback in MET thrusters according to prior approaches has been their use of a microwave power coupling, between the microwave generator and the resonant cavity and plasma, which typically consists of a rigid waveguide with impedance matching equipment. Such waveguides and their associated impedance matching hardware, however, greatly adds to the weight and size of the propulsion system, making it impractical for spaceflight. In particular, the size of the system and rigid waveguide connections make it difficult to place the MET thrust chamber on a steerable gimbaled platform on the spacecraft.

Another drawback in MET thrusters according to prior approaches has been their proposed use of fuels (e.g., hydrogen, helium, ammonia, and hydrazine) which are either highly toxic, flammable, irritating or difficult to store. This has limited the usefulness of the MET, making any proposed launching of satellites propelled by MET thrusters from the cargo bay of the space shuttle very expensive due to precautions and tests needed to ensure the safety of the shuttle crew in case of fuel leaks. The processing and testing of proposed ME-equipped satellites to be launched on ordinary boosters was also complicated and made more expensive by the presence of dangerous fuels carried for the MET thruster.

The foregoing problems are overcome, and other advantages are provided by not only greatly reducing or eliminating the waveguide and impedance matching equipment, but also providing a safe, non-toxic fuel for the MET thruster.

SUMMARY OF THE INVENTION

It is a general object of the present invention to provide a reduced weight coupling for MET thrusters. More particularly, it is an object of the present invention to provide a MET thruster which is capable of operating efficiently with a safe, non-toxic fuel.

A principal feature of the present invention is the reduced size or elimination of waveguide and impedance matching equipment, and use of water in the pure or impure state as the fuel in a MET thruster. More efficient embodiments of the MET thruster according to the present invention are realized by using an isolator in the transmission line between the MET thruster and the microwave source.

Among the advantages of the invention are the resultant lower weight and therefore cheaper launch cost of vehicles employing the invention.

These and other objects, features and advantages which will be apparent from the discussion which follows are achieved, in accordance with the invention, by providing a novel, compact coupling for microwave-electro-thermal thrusters.

The various features of novelty which characterize the invention are pointed out with particularity in the claims annexed to and forming a part of this disclosure. For a better understanding of the invention, its advantages and objects, reference is made to the accompanying drawings and descriptive matter in which a preferred embodiment of the invention is illustrated.

DETAILED DESCRIPTION OF THE PREFERRED EMBODIMENTS

Figure 1:
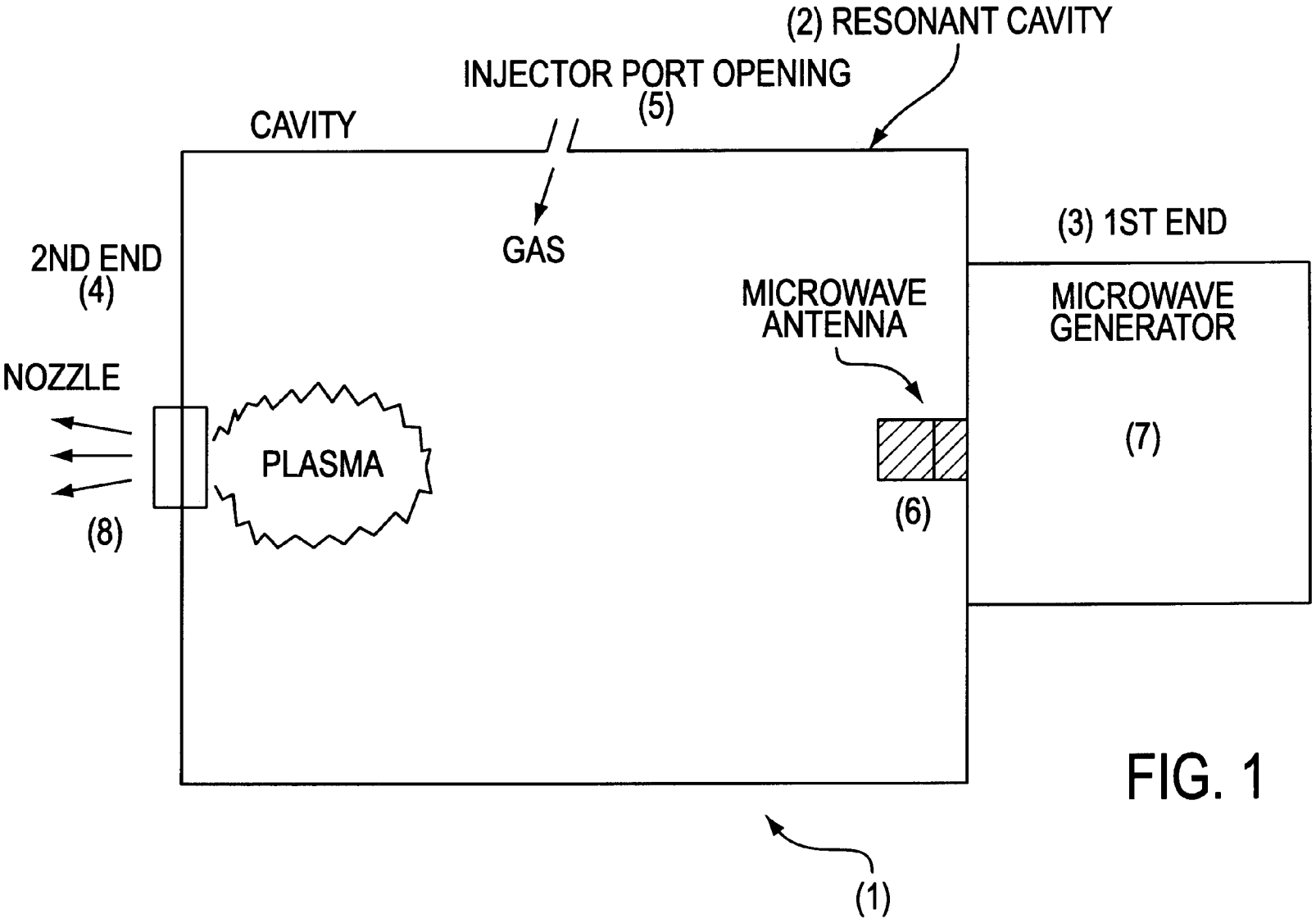
FIG. 1 is a schematic diagram of the invention.

Referring now to the drawings, wherein like characters designate like or corresponding parts throughout the several views, there is shown in FIG. 1 a MET thruster (1) comprises an approximately resonant cavity (2) having first (3) and second (4) ends, at least one injector port opening (5) in the cavity (2) for the injection of fuel in the form of a gas (as shown) or liquid (not shown), a microwave antenna (6) carried by the first end (3) of the cavity (2). The microwave antenna (6) is coupled to a microwave generator (7) which generates microwaves which are emitted into the cavity (2) where they interact with the heat and gas so as to create a heated gas plasma. A nozzle (8) carried by the second end (4) of the cavity (2) allows for the exit of the heated gas plasma. As the plasma exits the cavity (2), it creates thrust which may be used to control the spacecraft.

Preferably, the MET thruster may be operated with a magnetron microwave generator inserted directly into the resonant cavity (2) with no intermediate waveguide, but only a tuned ¼ free-space wavelength antenna being used. This innovation results in a much more compact and lightweight design for the MET than has been previously been demonstrated for the MET and makes the MET an attractive technology for space flight.

A microwave generator, such as a magnetron, klystron, or traveling wave tube, is joined directly with a resonant cavity in a coaxial configuration with the output stub of the microwave generator inserted into the approximately resonant cavity to excite a transverse magnetic, azimuthally symmetric, bisymmetrically along the axis (TM010 mode) for the purpose of heating a plasma which acts as a thermal rocket exhaust. The resonance condition of the cavity being only approximate due to the loading of the cavity by the discharge. The sole impedance matching element between the microwave generator and the cavity is an antenna attached to the output stub of the generator tuned to be ¼ of a free space wavelength in effective length and this antenna projects into the resonant cavity. This allows a lighter MET system to be used in space without using bulky waveguides and other impedance matching devices being interposed between the generator and the cavity.

Figure 2:
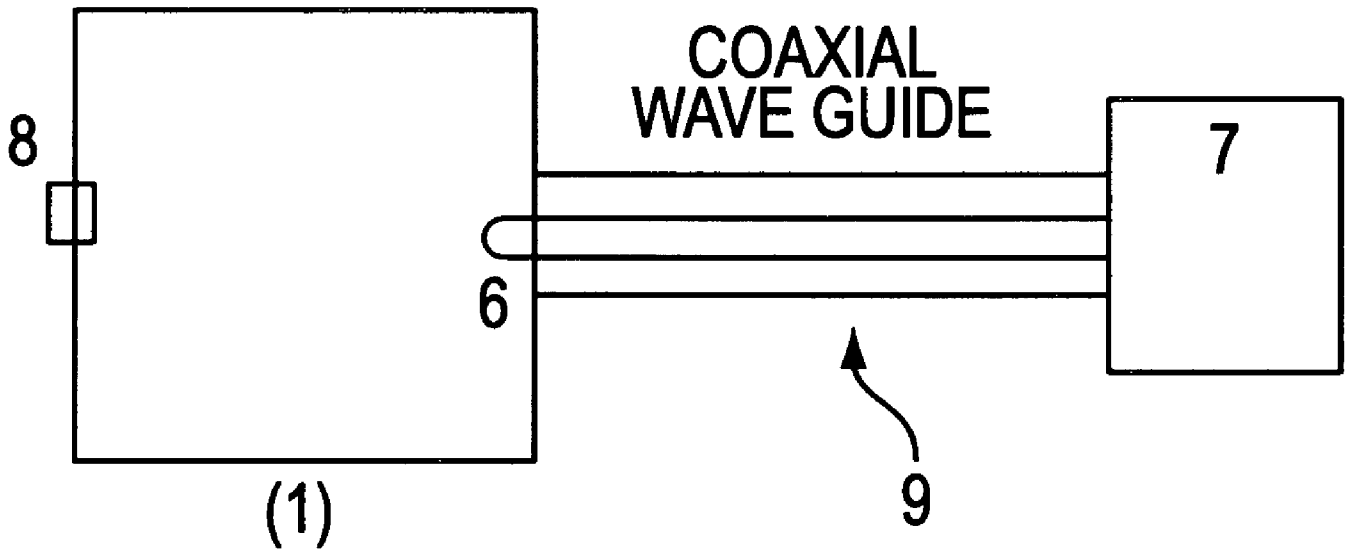
FIG. 2 illustrates an embodiment of the invention using a coaxial waveguide.
Figure 3:
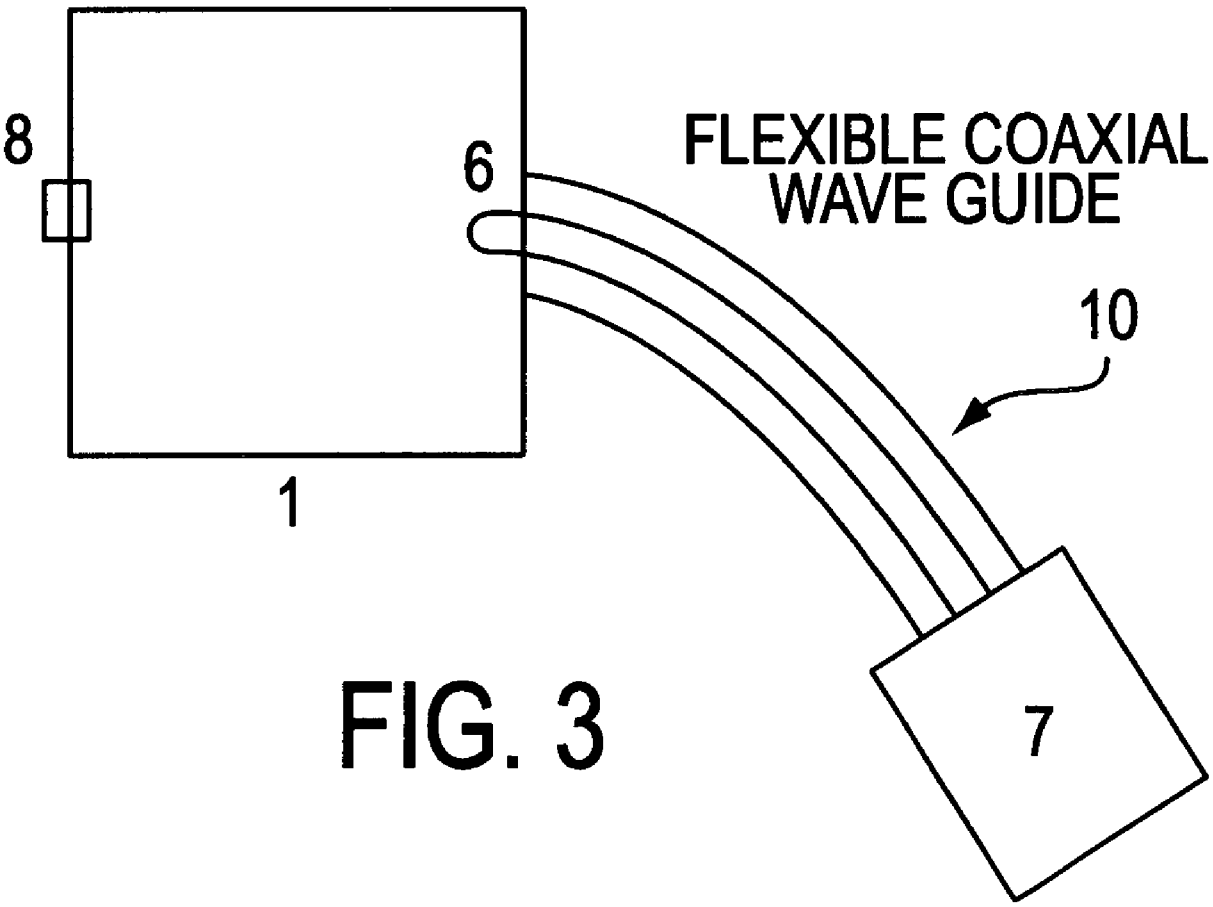
FIG. 3 illustrates an embodiment of the invention using a flexible coaxial waveguide.
Figure 4:
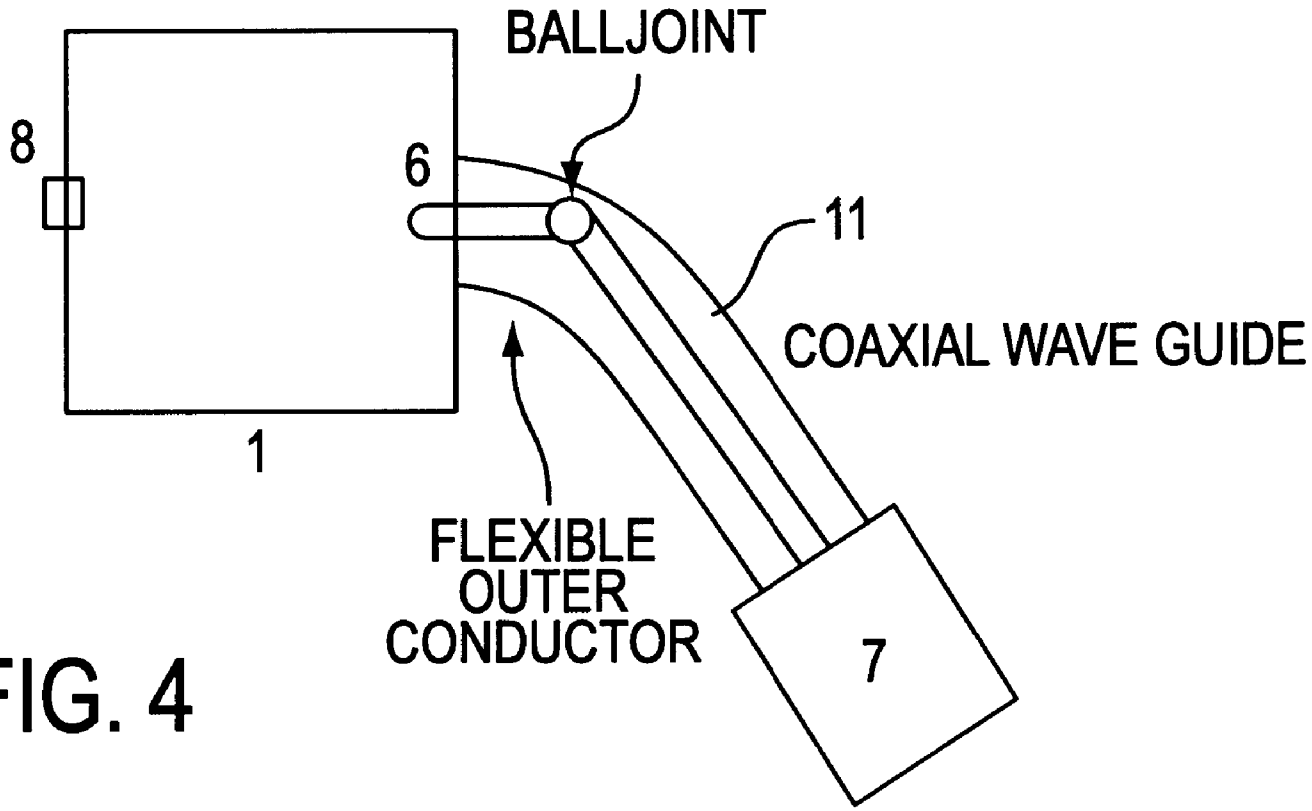
FIG. 4 illustrates an embodiment of the invention using a waveguide with flexible outer conductor and balljoint inner conductor.
Figure 5:
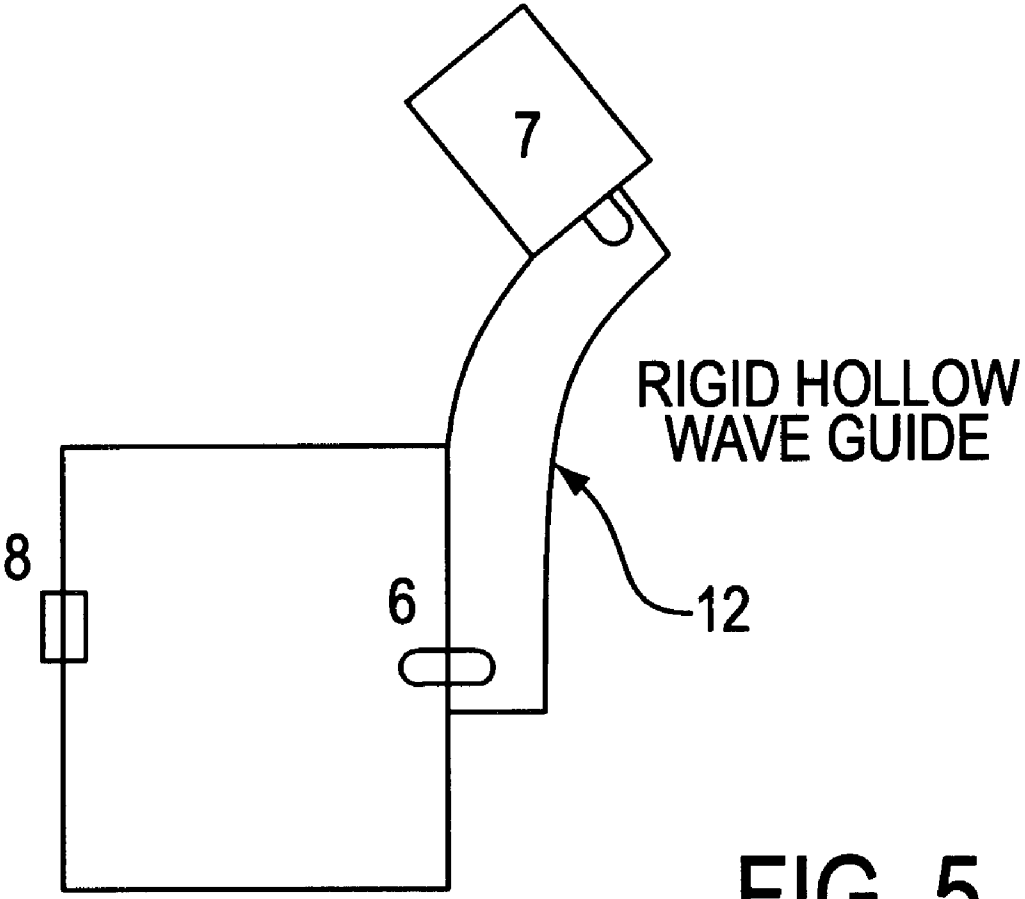
FIG. 5 illustrates an embodiment of the invention using a rigid hollow waveguide.
Figure 6:
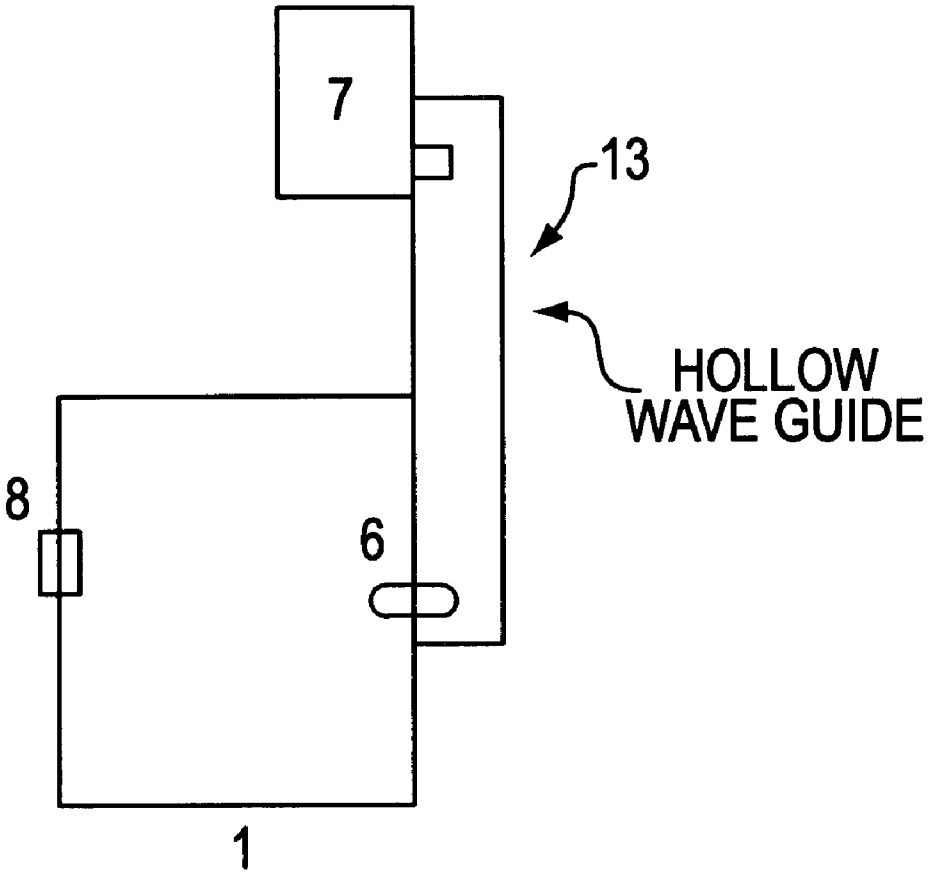
FIG. 6 illustrates an embodiment of the invention using a hollow waveguide.
Figure 7:
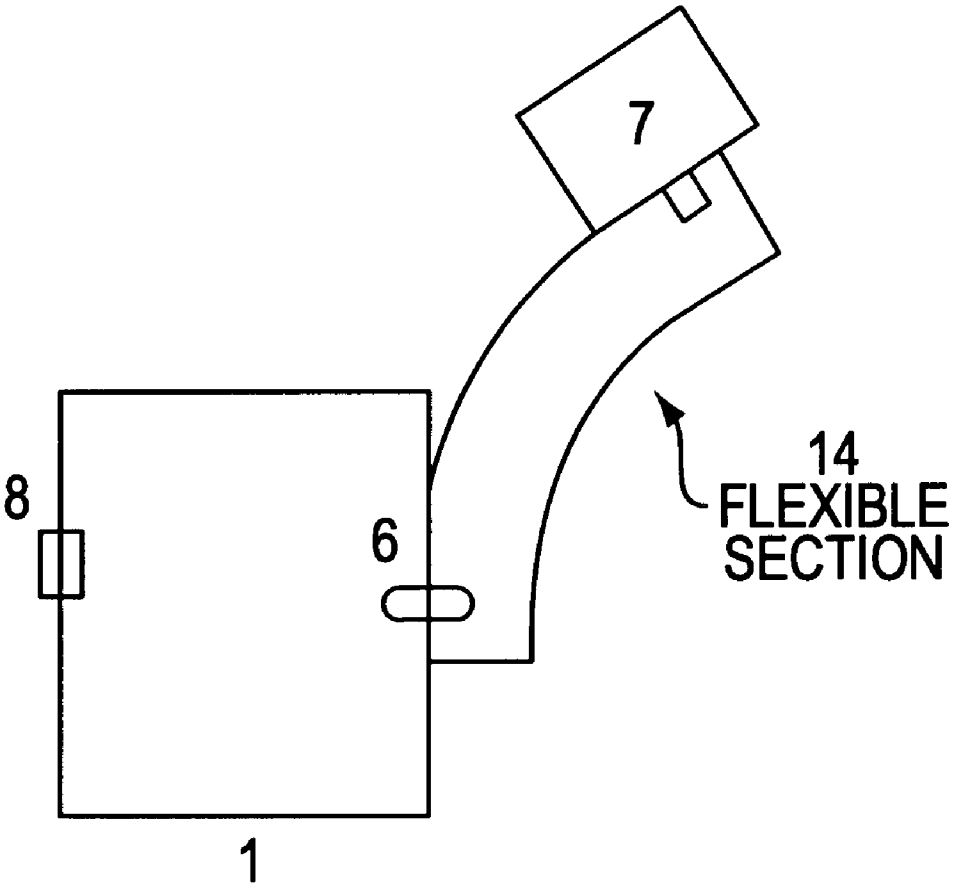
FIG. 7 illustrates an embodiment of the invention using a flexible section.

Connectors less than two (2) wavelengths long would provide the desired advantages and could consist of rigid coaxial waveguide (9, FIG. 2), waveguide with flexible inner and outer conductors (10, FIG. 3), waveguide with a flexible outer conductor and a universal or balljointed inner conductor (11, FIG. 4), rigid non-axial generator mounted on a bent hollow waveguide (12, FIG. 5), rigid hollow waveguide (13, FIG. 6), or waveguide with a flexible section (14, FIG. 7). There is no requirement that the waveguide be coaxial with the cavity, and non-coaxial configurations may provide advantages from the viewpoint of heat management.

In accordance with one important aspect of the present invention, the fuel preferably comprises water or water vapor. A source of pure or impure water or water vapor is injected either in its gaseous or liquid state into the thrust chamber of the MET where it is vaporized by the microwave fields and low pressures experienced therein. The vaporized water then breaks down electrically and forms a plasma in the microwave discharge, which is heated to form a high velocity rocket exhaust. Optionally, the water may be used not only as the fuel, but also to cool MET thruster components such as the magnetron before being sent to the thrust chamber. Additives such as alcohols or glycols may be used to enhance the performance and storability of the water used as MET fuel. Moreover, non-potable water and waste water from human space flight may be used as alternative sources of the water and/or water vapor. Gases dissolved in the water under pressure (e.g., noble gases such as helium or molecular gases such as nitrogen) may be used to aid the ignition and stability of the MET discharge. If desired, although not necessary, special nozzle materials such as refractory oxides (e.g., thoria) may be used to minimize any potential problems encountered with nozzle erosion caused by the use of water (and its potential additives) as a fuel.

Figure 8:
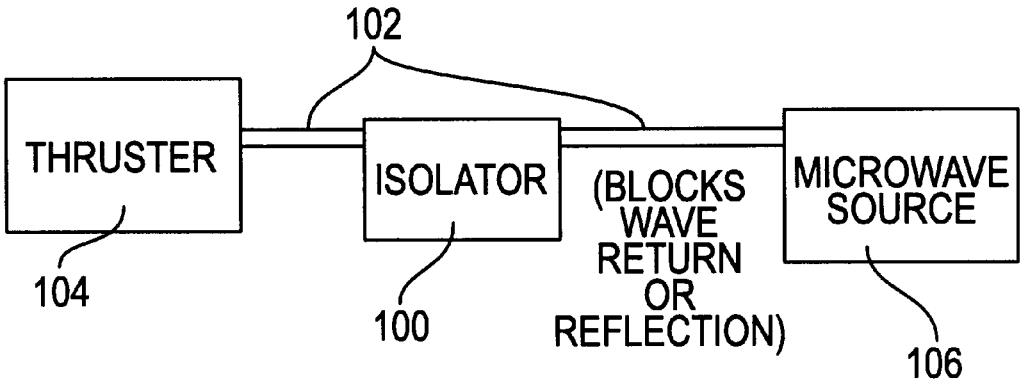
FIG. 8 is a block diagram of an improved MET thruster according to another embodiment of the present invention.

Referring now to FIG. 8, there is shown therein a block diagram of an improved MET thruster according to another embodiment of the present invention. It has been found that, in order to run the MET most efficiently and to safeguard the long life of the microwave source by preventing large amounts of reflected power, an isolator (100) may be added to the waveguide or microwave power transmission line (102) between the MET thruster (104) and the microwave source (106). Such microwave isolators (100) are well known, and are standard pieces of microwave hardware which allows microwaves to pass through the transmission line (102) from the microwave source (106) to the MET thruster (104), but blocks or absorbs the microwaves trying to move back to the source (106). The isolator (100) may be attached to the source (106) itself or to the MET thruster (104), or anywhere on the transmission line (102) where it is most practical from a heat dissipation standpoint.

Figure 9:
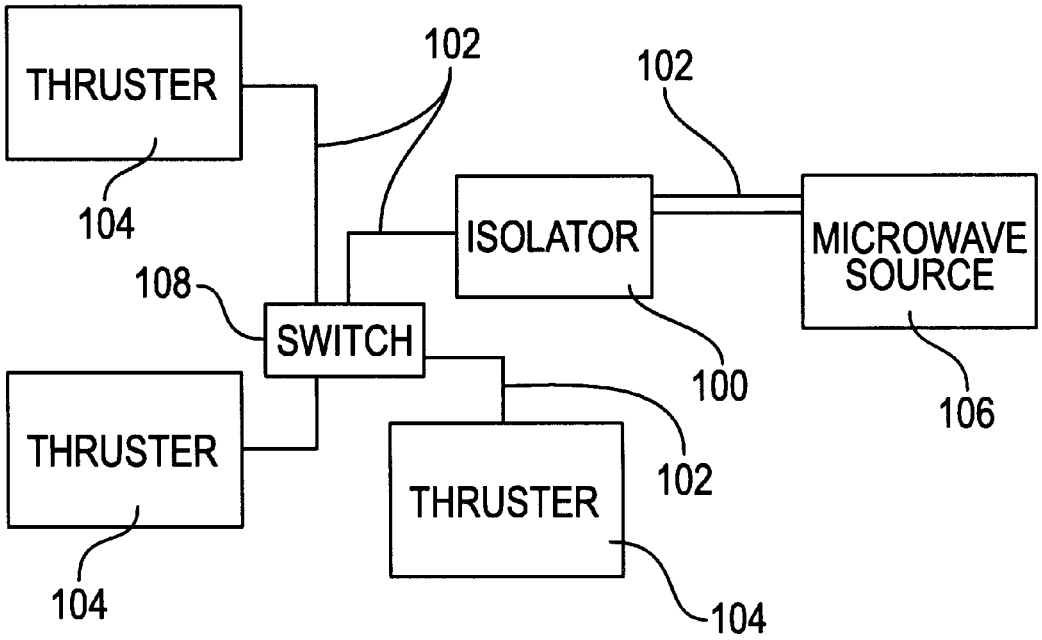
FIG. 9 is a block diagram of an improved MET thruster according to still another embodiment of the present invention.

Referring now to FIG. 9, there is shown therein a block diagram of an improved MET thruster according to still another embodiment of the present invention. In this embodiment, a plurality of MET thrusters (104) are shown connected to the microwave source (106) by way of a network of transmission lines (102). Like the former embodiment, this embodiment employs a microwave isolator (100) in the transmission line (102) coming from the microwave source (106), and additionally comprises a microwave switch (108) to channel the microwaves to selected ones of the MET thrusters (104). This permits one or more of the MET thrusters (104) to be singly or simultaneously used.

Experimental Results

A prototype compact coupling experiment was conducted in which a Panasonic 2M210 Magnetron output (2.45 Ghz) was attached to an approximately TM010 resonant mode cavity on its axis via a coaxial waveguide of 7/4 wavelength (21 cm) and by directly inserting its ¼ (3 cm) wavelength antenna into the cavity on axis. The MET performed in the direct insertion mode just as it had at the end of the waveguide and the discharge was unchanged. Thermal safety switches in place on the magnetron, designed to shut off the power in case of magnetron overheating, which would indicate high reflected power and thus poor impedance matching, did not trigger during operation, indicating the magnetron ran with normal temperature range and thus was adequately matched.

Similarly a magnetron (such as a Toshiba 2M172) was used to drive the cavity by inserting its output antenna into a hollow waveguide coupled to the cavity via an output antenna located at the end of the waveguide. This allowed the magnetron to be mounted adjacent to the cavity. In this experiment the magnetron was mounted side-by side with the cavity with only 21 cm separating their centers. It is possible that microwaves could be coupled between a cavity and a magnetron using a coaxial waveguide with a flexible portion, thereby allowing the cavity to be tilted relative to the fixed waveguide, as is common practice in the microwave field.

In another experiment, water vapor in the form of steam was introduced under pressure into a MET thruster as described herein above. Such water vapor, when exposed to the microwaves, formed an intense, bluish-white discharge and a high-velocity exhaust. The discharge was observed to be steady and did not cause measurable erosion of the graphite nozzle. Thus, previous objections that water would not form a steady discharge or would severely erode the nozzle were overcome through use of the MET thruster according to the present invention.

Thus, there has been disclosed a novel compact coupling for microwave-electro-thermal thrusters and a manner of making and using the fuels and isolators according to invention herein described.

While specific embodiments of the invention have been shown and described in detail to illustrate the application of the principles of the invention, it will be understood that the invention may be embodied otherwise without departing from such principles and that various modifications, alternate constructions, and equivalents will occur to those skilled in the art given the benefit of this disclosure. Thus, the invention is not limited to the specific embodiment described herein, but is defined by the appended claims.

What I claim as my invention is:

1. A device for propulsion or attitude control of a steerable gimbaled platform on a spacecraft in space, comprising:

a source of water-based fuel;

a resonant cavity having first and second ends;

an injector port opening in said cavity for injection of said water-based fuel;

a microwave antenna of a predetermined wavelength carried by said first end of said cavity, said microwave antenna coupled to a microwave generator for generation of microwaves for interaction with said fuel so as to heat said fuel and create a heated gas plasma, wherein said predetermined wavelength is less than 2 wavelengths long; and a nozzle carried by said second end of the cavity for exit of said heated gas plasma.

2. A device according to claim 1, wherein said microwave antenna comprises a tuned ¼ free-space wavelength antenna.

* * * * *